United States Patent [19]

Braico

[11] 4,011,573

[45] Mar. 8, 1977

[54] APPARATUS FOR DEVELOPING DENTAL X-RAY FILMS

[75] Inventor: Louis J. Braico, Elgin, Ill.

[73] Assignee: Rinn Corporation, Elgin, Ill.

[22] Filed: Dec. 23, 1974

[21] Appl. No.: 535,941

[52] U.S. Cl. ..... 354/322; 354/329; 354/345

[51] Int. Cl.[2] ..... G03D 3/08; G03D 13/10

[58] Field of Search ..... 354/315, 316, 319, 320, 354/322, 328, 329, 330, 344, 345, 346, 347, 342, 343; 134/64 P, 122 P

[56] References Cited

UNITED STATES PATENTS

| | | | |
|---|---|---|---|
| 1,466,339 | 8/1923 | Plante | 354/345 |
| 2,186,891 | 1/1940 | Wilson | 354/346 |
| 2,519,337 | 8/1950 | Alberts et al. | 354/329 X |
| 2,544,644 | 3/1951 | Allen | 354/322 |
| 2,766,670 | 10/1956 | Fritts | 354/345 |
| 3,010,377 | 11/1961 | Kettler | 354/316 |

*Primary Examiner*—Fred L. Braun
*Attorney, Agent, or Firm*—McWilliams & Mann

[57] ABSTRACT

An apparatus for developing dental X-ray film of the dip and dunk type, in which the apparatus is provided with a plurality of processing stations disposed in an arcuate path that is concentric about a vertical axis, which stations comprise loading, developing, rinse, fix, final rinse, drying, and unloading stations, with the developing, rinse, fix, and drying stations being defined by open topped receptacles. The individual films are clipped to special film hangers which are removably suspended from a cantilevered support that rotates intermittently about the said vertical axis, and also is moved vertically to dispose the individual hangers elevationally to move between stations and then lower the hangers into the respective receptacles for the processing to be performed there, in which position the hanger support reciprocates vertically for purposes of agitating the film in its bath. At the drying station, the individual hangers are journaled for rotation about their longitudinal axes at a speed on the order of 3,000 rpm for spin drying of the film.

14 Claims, 20 Drawing Figures

APPARATUS FOR DEVELOPING DENTAL X-RAY FILMS

This invention relates to a method and apparatus for developing dental film, and more particularly, to a method and apparatus for developing dental film that is of the dip and dunk type, of which that shown in Hunt U.S. Pat. No. 3,412,667 is illustrative.

The apparatus of the Hunt patent is concerned with development of dental X-ray film wherein a plurality of receptacles containing the necessary baths are arranged along an arcuate path concentric to a vertical axis, with the individual films being applied to racks or hangers that are supported by a circular carrier which overhangs the baths and is intermittently rotated about said vertical axis, and also moved vertically to lift the films over the walls of the respective containers, to move the film being processed to the next processing station, and then lowered to lower the film for processing at that station. The film after immersion in the developer, fix and rinse baths, is disposed for drip draining into a drip tray, after which the film is brought to the unloading station.

A principal object of the invention is to generally improve the general arrangements shown in the aforementioned Hunt patent, particularly with reference to the individual film hangers, the provision of spin dry facilities that also include temporarily rotatably mounting, as part of the processing procedure, the individual film hangers, and a general revision of the over-all structural arrangement involved to facilitate film processing.

Another principal object of the invention is to provide a method and apparatus for the development of dental X-ray films which provides for automatic handling of the film through processing steps that leave the film fully developed and dried for immediate inspection, mounting, and the like that may be in order as part of the practice of dentistry.

Another principal object of the invention is to provide an apparatus for processing dental X-ray film that is compact, simplified, and automatically operated through the whole film processing cycle, whereby the dental nurse or technician is concerned only, insofar as film development is concerned, with application of the film to and from the hangers, and the application of the film hangers to and from the apparatus.

Another principal object of this invention is to provide a film hanger arrangement that accommodates ready securement of the individual films to the hanger by a clipping action that adapts the hanger for spin dry processing of the film carried thereby as part of the basic functioning of the apparatus, and that holds the individual films firmly in place against the action of centrifugal forces that will be involved in the spin dry treatment of the film.

Other objects of the invention are to generally revise the physical arrangement of the apparatus of the aforementioned Hunt patent to improve its operation and reliability, to provide a method and apparatus for developing dental X-ray film that is practical for the individual dental practitioner to have in his office, and to provide a dental X-ray film apparatus that is inexpensive of manufacture, easy to operate, and long lived in use.

In accordance with this invention, the apparatus is provided with a housing that at its top contains receptacles that define developer, rinse, two fix and a final rinse, baths, in that order, together with a receptacle in which the individual hangers are temporarily journaled for spin drying of the film carried by same.

These receptacles are disposed concentrically about a vertical axis about which also operates a cantilevered support arm from which the individual film hangers are removably suspended. The support arm is raised and lowered and rotated horizontally, on and about said axis, intermittently, and in a step by step manner to automatically transport the individual hangers from a loading station at the front of the machine, and to raise and lower the hangers so that the hangers will clear the respective container walls and be lowered into the containers as part of the dip and dunk processing procedure, to an unloading station that is also at the front of the apparatus. At the drying station, the individual hangers are temporarily journaled and spun at a speed on the order of 3,000 rpm to fully dry the film prior to the film proceeding to the unloading station.

The individual film holders each comprise a rod or shaft member equipped at its upper end with a handle and a journal portion for journal type support from the apparatus support arm, and at its lower end with a coupling element adapted to frictionally be coupled with a power driving coupling element journaled in the drying receptacle on which the rod or shaft member is rested during the drying step. In between the rod or shaft member ends are a plurality of film holder assemblies that each include a plurality of clip devices to which the individual films are secured in a manner that effectively resists the effect of centrifugal forces that will be acting on the film during the spin drying processing of same. The film holder assemblies are each in the form of clip type holders of a special type having gripping jaws especially suited to grip the film, considering the nature of the film and the spin dry processing of the films that is involved in accordance with the invention.

Other objects, uses and advantages will be obvious or become apparent from a consideration of the following detailed description and the application drawings in which like reference numerals indicate like parts throughout the several views.

However, it is to be distinctly understood that the specific drawing illustrations provided are supplied primarily to comply with the requirements of the Patent Laws, and that the invention is susceptible of other embodiments that will be obvious to those skilled in the art, and which are intended to be covered by the appended claims.

GENERAL DESCRIPTION

Figure 1:
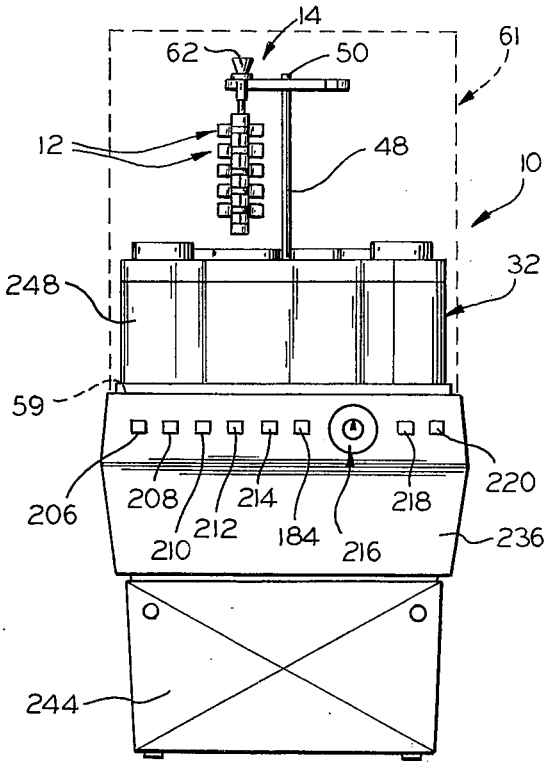
FIG. 1 is a small scale front elevational view of one embodiment of the invention, to which has been applied a hanger of the type contemplated by this invention that carries the dental film to be processed.
Figure 2:
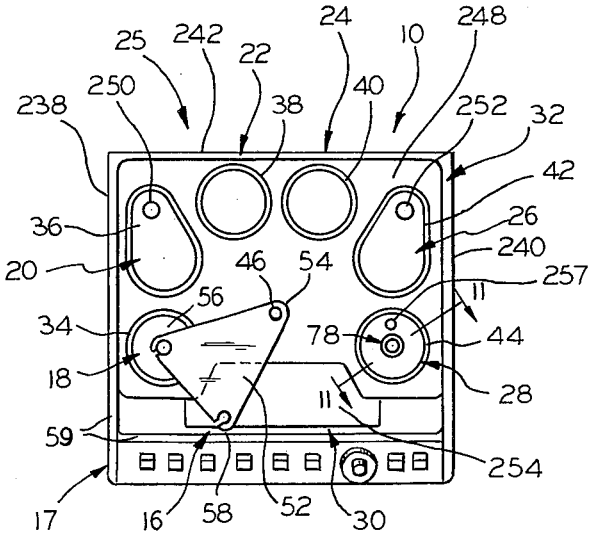
FIG. 2 is a plan view of the structure shown in FIG. 1, with the dental film hanger advanced from its loading position to its developing position.

Reference numeral 10 of FIGS. 1 and 2 generally indicates one embodiment of the invention which is arranged to process individual dental films 12 applied to a hanger 14 in a dip and dunk procedure starting from the loading station 16 (see FIG. 2) at the front side 17 of the apparatus 10, and progressing the hanger 14 through a developer station 18, a rinse or wash station 20, two fix stations 22 and 24 at the rear 25 of the apparatus 10, a final rinse or wash station 26, a spin dry station 28, and an unloading station 30 at the front of the apparatus 10.

In the form shown, the apparatus 10 comprises a suitable housing 32 which suitably mounts developer container or receptacle 34, rinse receptacle or container 36, the two fix containers or receptacles 38 and 40, the final wash container or receptacle 42, and a spin dry container or receptacle 44. The loading station 16 and the unloading station 30 are in side by side relation at the front of the machine exteriorly of the housing 32.

Figure 9:
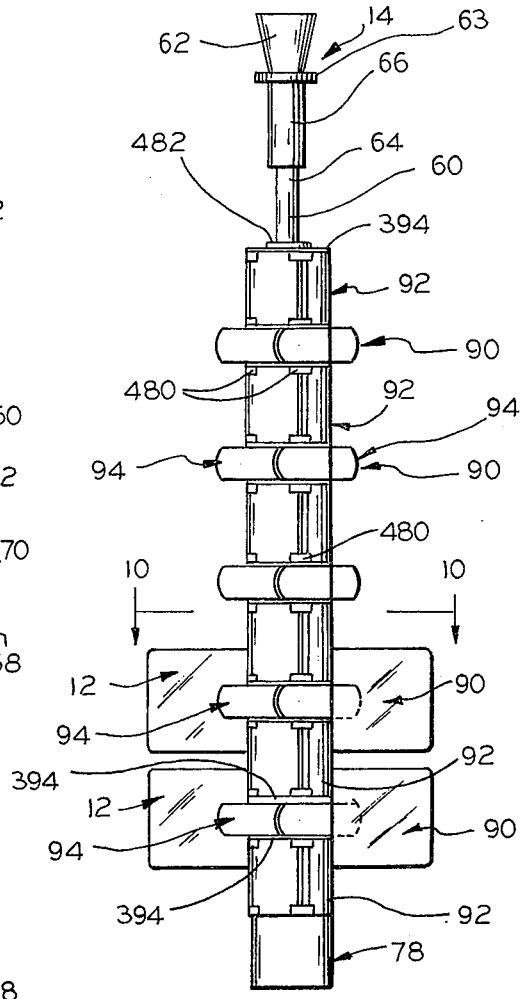
FIG. 9 is a side elevational view of the film hanger shown in FIGS. 1 – 3, but on an enlarged scale.
Figure 10:
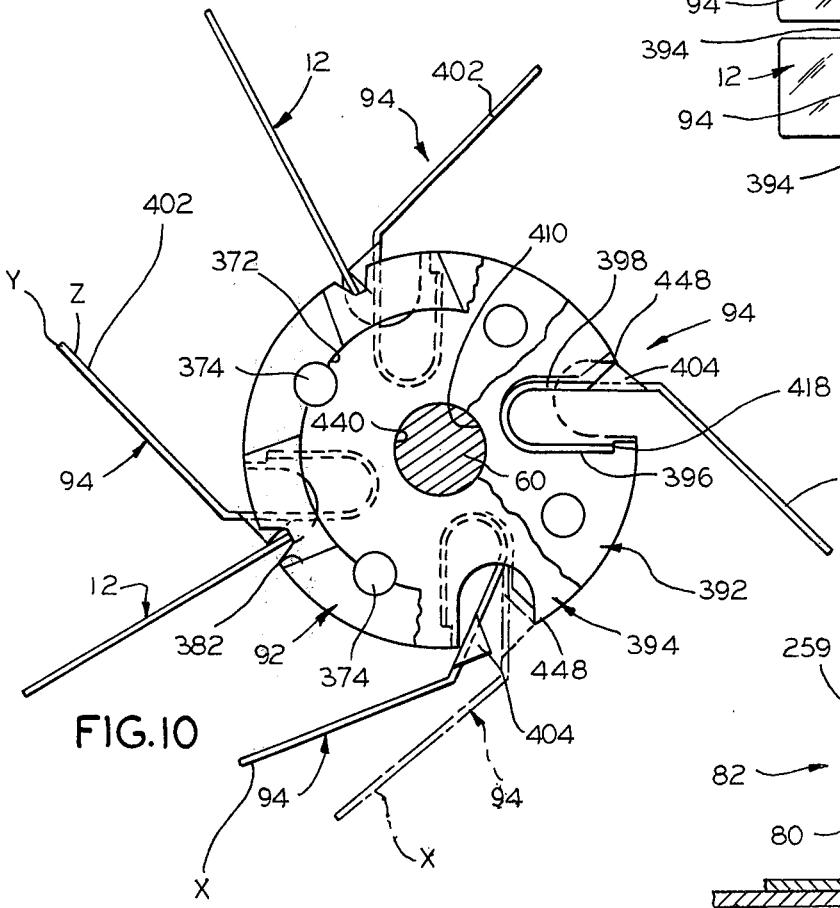
FIG. 10 is a transverse cross-sectional view through the hanger of FIG. 9, taken approximately along line 10—10, with parts being broken away to better illustrate the general arrangement involved and the holding action of the film grip devices on the individual films.

The stations 18, 20, 22, 24, 26, 28 and 30 are in concentric relation about a vertical axis 46 in alignment with which operates vertical support rod 48 that has secured to its upper end 50 the hanger support arm 52 that, in the form of the invention illustrated, is of triangular configuration, with the support arm 52 being affixed to the rod 48 at one apex 54 and having the other apexes 56 and 58 thereof formed to each removably receive and support a hanger 14 bearing the individual films 12 in the manner indicated in FIGS. 9 and 10. Housing 32 is formed to define a ledge 59 thereabout on which rests suitable hood 61 (shown only diagrammatically) that may be of the daylight or dark room type, as desired.

The hanger 14 generally comprises a rod or shaft 60 having a handle 62 secured to the end 64 of same which includes a flange 63 and a journal portion 66 proportioned to fit in close fitting relation with the respective openings 68 and 70 (see FIG. 8) of the support arm apexes 56 and 58 for the purpose of removably supporting the individual holders 14 from the support arm 52. Access to the respective openings 68 and 70 of the support arm 52 is by way of the respective slots 72 and 74 which are proportioned to receive the hanger rod 60 but not the hanger journal portion 66.

Figure 11:
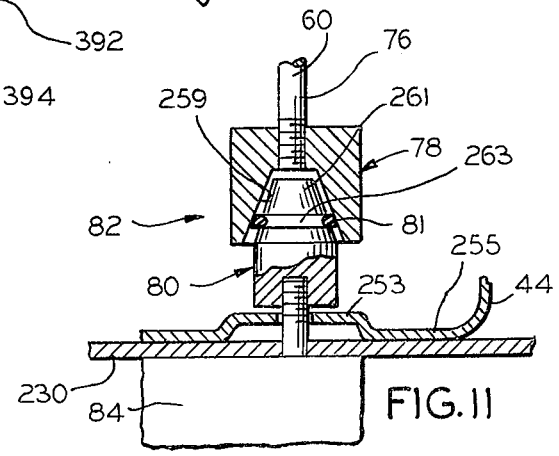
FIG. 11 is a fragmental vertical sectional view taken substantially along line 11—11 of FIG. 2, illustrating the manner in which the individual hangers are coupled to the drive for spin drying the film.
Figure 12:
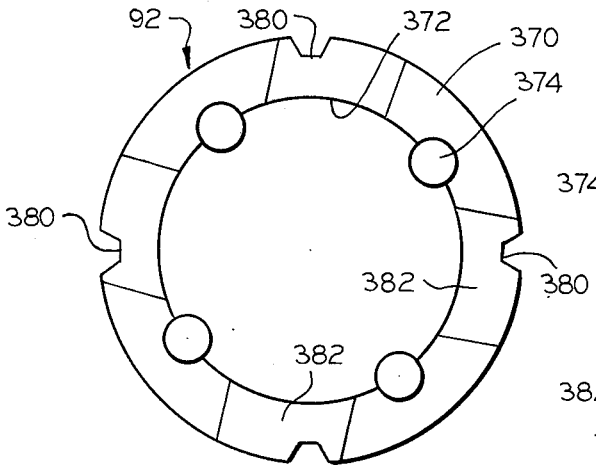
FIG. 12 is an end view of a spacer segment forming a part of the hanger assembly.
Figure 13:
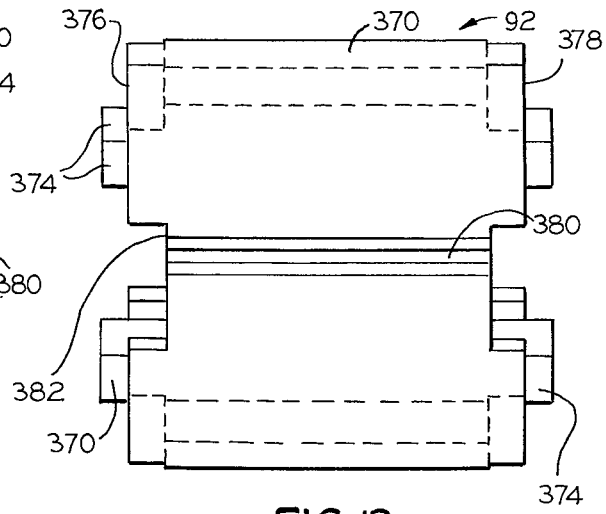
FIG. 13 is a side elevational view of the spacer element shown in FIG. 12.

At the lower end 76 of the hanger rod 60 a coupling element 78 is secured to the rod for cooperation with drive element 80 (see FIG. 11), through O-ring type friction coupling element 81, with these parts comprising a spin dry mechanism operated by suitable motor 84 for rotating the individual hangers 14, when at the station 28, at a speed on the order of 3,000 rpm.

Applied to the hanger rod 60 between coupling element 78 and handle 62 are a plurality of dental film holder devices 90 separated by spacers 92. The film holder devices 90 each comprise a plurality of dental film clip members 94, with four such members 94 being employed in each dental film holder device 90 and spaced approximately 90° apart, as indicated in FIG. 10, to space the individual films 12 from each other.

The hanger support arm 52 and the support rod 48 to which it is affixed are intermittently moved vertically and rotated horizontally, in accordance with this invention, to shift the individual hangers between stations, and while at the stations between the loading and unloading stations, the support arm and support rod 48 are reciprocated vertically for film agitation purposes.

Figure 3:
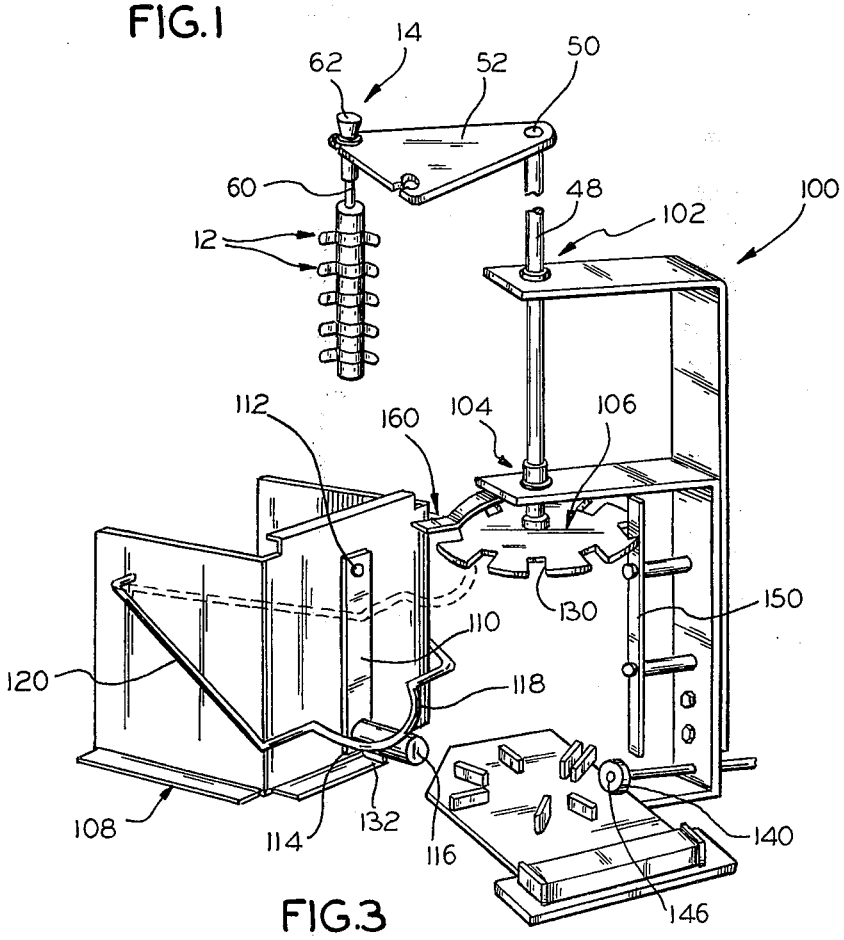
FIG. 3 is a diagrammatic perspective view illustrating the basic mechanical operative parts of the apparatus.
Figure 4:
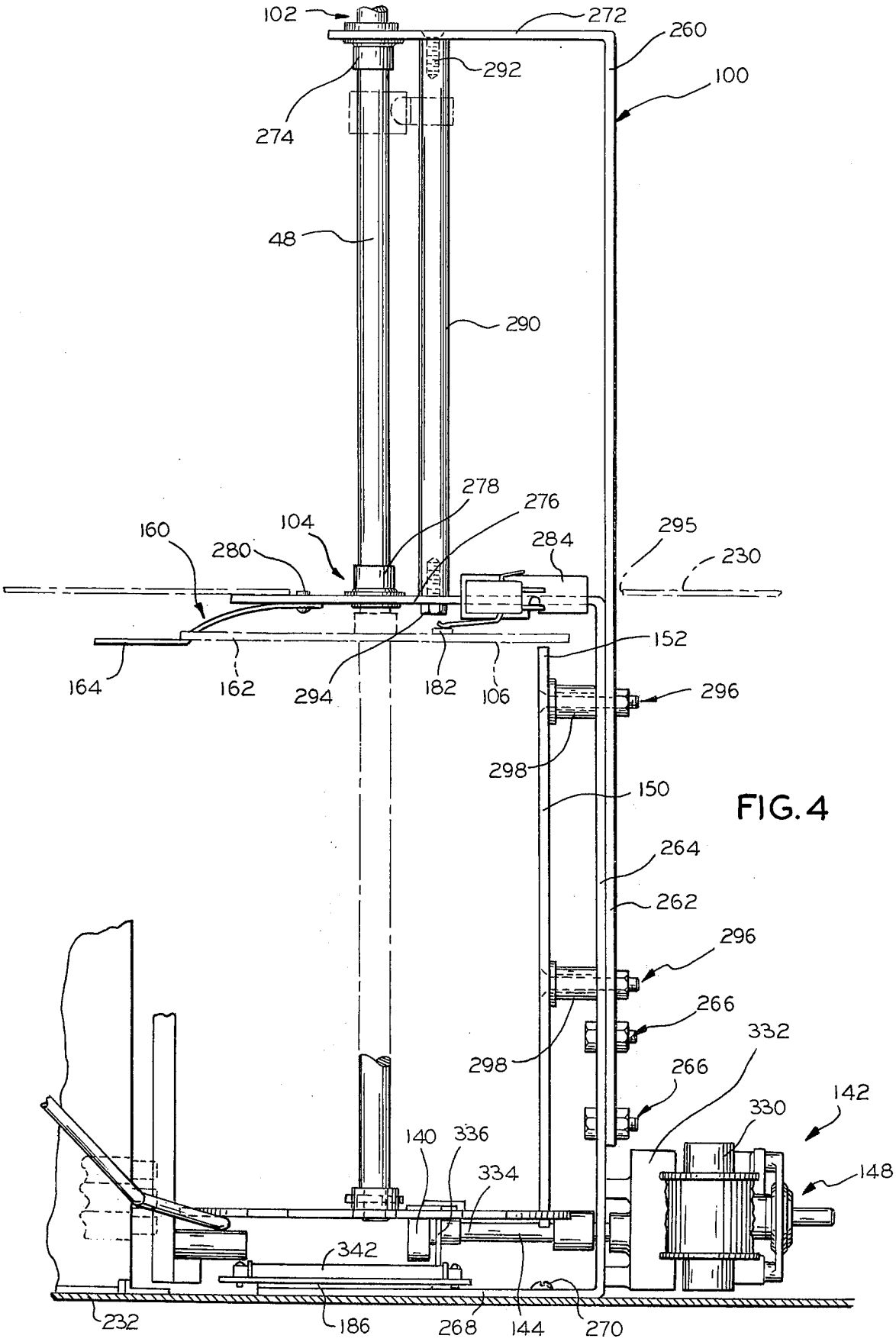
FIG. 4 is a fragmental side elevational view, on an enlarged scale, of the apparatus indexing plate and the manner of supporting same and guiding same for its vertical and rotational movement in accordance with the invention.

For these purposes, the support rod 48 is mounted in suitable support structure 100 (that is suitably connected to the housing 32 for positioning in the upright position indicated in FIGS. 3 and 4), in which the support rod 48 is journaled as at 102 and 104 for rotational movement as well as movement longitudinally thereof.

The support rod 48 is equipped with indexing disc 106 which is raised and lowered, and intermittently rotated, to correspondingly move the support rod 48 and support arm 52 (and the hangers carried by same), under the action of drive mechanism 108 which includes swing arm 110 that is rotated about a horizontal axis 112 and has at its projecting end 114 a cam roller 116 in camming engagement with the bight portion 118 of a bail member 120 having its ends 122 and 124 journaled for pivotal movement about a horizontal axis 126 that is disposed adjacent the level of the axis 112 and intermediate the raised and lowered positions of the indexing disc 106. The disc 106 includes a plurality of peripheral notches 130 in equally spaced relation about the periphery of the indexing disc 106 each of which is of equal radial depth, relative to the disc 106, except the notch marked 130A (see FIG. 6), which is of less radial depth but has the peripheral spacing of the other notches 130. Swing arm 110 is equipped with a tab 132 adapted to cooperate with the indexing disc notches 130 and 130A to intermittently rotate the disc 106, and consequently the supporting rod 48 and the support arm 58, to move the individual hangers 14 between stations.

In the particular arrangement shown, the bight portion 118 of bail member 120 engages under the indexing disc 106 and except at the lowermost position of the disc 106, supports the disc 106, the support rod 48, and the parts that it carries including the hangers 14 being processed. As the swing arm 110 moves from its upwardly directed position to its downwardly directed position, the cam roller 116 moves from the mid portion of the bail bight portion 118 to one side of same, and then back to the mid portion of the bight portion 118 (see FIG. 7), with the indexing disc 106 in its lowermost position resting on the cam member 140 of agitation device 142 which includes a shaft 144 journaled to rotate about a horizontal axis 146 under drive mechanism 148 to rotate cam member 140 so as to reciprocate indexing disc 106 for purposes of agitation the film in the developer, rinse, and fix baths. The cam member 140 is formed and driven at a speed suitable for agitating purposes, with the speed being 60 rpm and the cam member 140 providing an agitation stroke of three-quarters of an inch in a preferred embodiment of the invention.

Also cooperating with the indexing disc 106 is an upright guide bar 150 that is suitably secured to the support structure 100 and disposed to be received in all of the notches 130 (except notch 130A) of the indexing disc 106 so that the disc 106 is held against rotational or pivotal movement as it moves between its upper and lower positions. The notch 130A, however, is sufficiently shallow, radially of the disc 106, so that when the notch 130A is vertically aligned with the guide bar 150, the indexing disc 106 merely rests on the upper end 152 of the guide bar 150 when lowered to engage same. In this position, the support arm 52 and the film hangers 14 carried by same are disposed at the front side of the apparatus in the loading and unloading stations respectively.

Operably associated with the indexing disc 106 is a latch device 160 in the form of leaf spring 162 that is suitably secured to the support structure 100 and located and shaped to be received in one of the indexing disc slots 130 (including 130A) when the indexing disc is in its uppermost position, and is above the level of the upper end 152 of guide bar 150, whereby the indexing disc 106 is held against rotation until the appropriately positioned slot 130 (including 130A) is engaged by the swing arm tab 132 to give the desired increment of rotation to the indexing disc 106 and the parts it supports. For this purpose, the spring arm 162 is formed with an extension 164 that is engaged by beveled corner 166 of the swing arm 110 at its projecting end 114, whereby the leaf spring 162 is lifted out of the way in the timed sequence required to permit the increment of rotation of the indexing disc 106 that is provided by operation of the swing arm 110, which is sufficient to present the next disc slot 130 in the position to receive the leaf spring 162, which positioning also disposes the indexing plate 106 for the indicated cooperation with guide bar 150.

Figure 20:
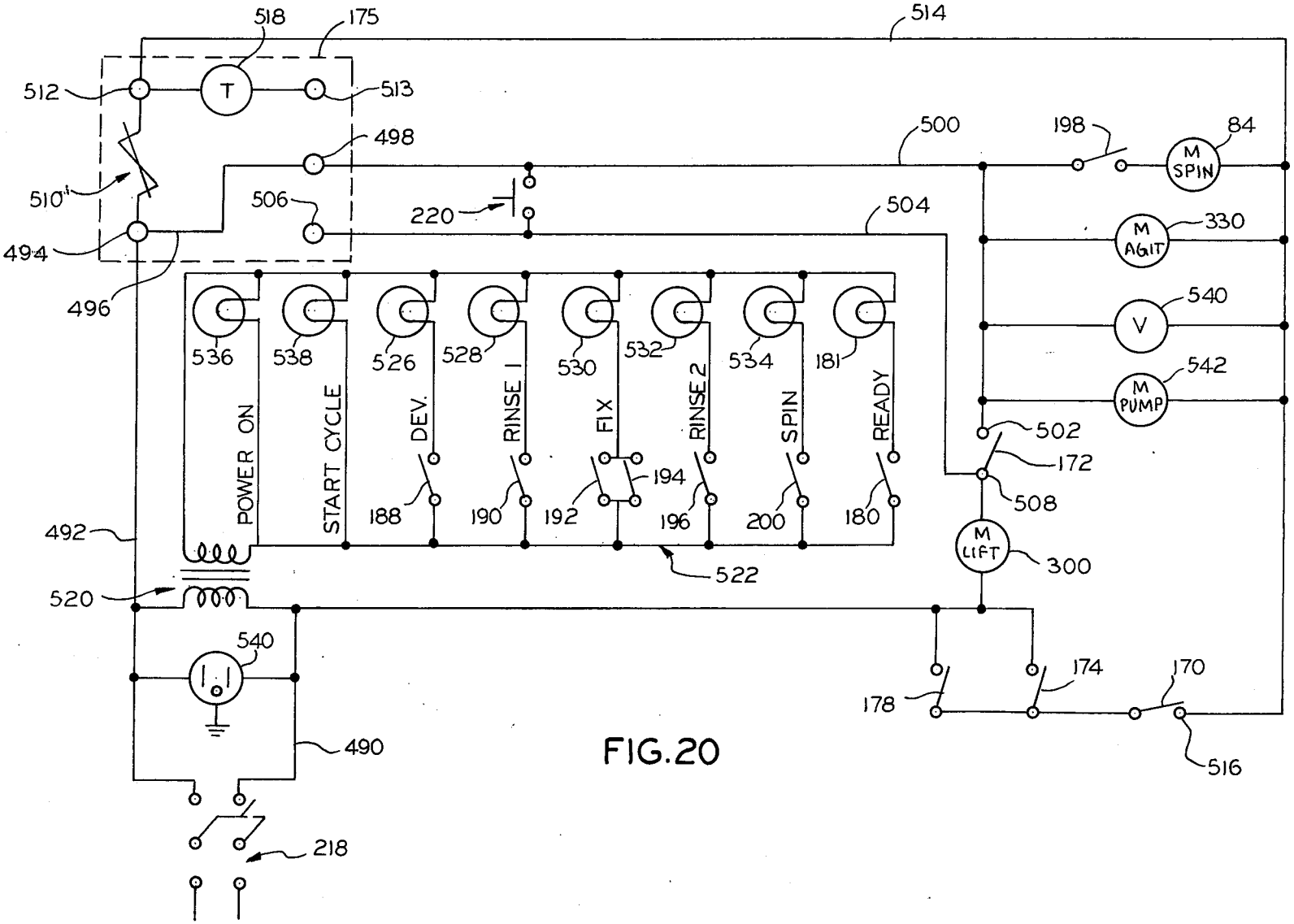
FIG. 20 is a wiring diagram illustrating schematically the control system of the apparatus.

Operatively involved in the apparatus 10 are microswitches 170, 172 and 174 (see FIGS. 5, 7 and 20) that are mounted in the housing 176 of drive apparatus 108 and are positioned for engagement by the swing arm 110 when it reaches its downwardly directed position. Switch 170 actuates the agitator drive device 142 and a delay interval timer 174 (shown diagrammatically in FIGS. 7 and 20) that is electrically connected as indicated in FIG. 20 to reactuate the drive mechanism 108 at the end of a suitable period of time dwell of the hangers in their lowered positions. Switch 172 shuts off swing arm drive mechanism 108 and switch 174 is required to be open, together with switch 178 (see FIGS. 6 and 20) to end the cycling of apparatus 10. The timer 174 may be of any conventional type having the functions indicated, such as the model 536-025-0 unit made by Paragon Electric Co. Operably secured to the support structure 100 are the switches 178 and switch 180 (see FIG. 6) that are actuated by a common actuator plate 182 carried by the indexing plate or disc 106. Switch 178 is connected as indicated in FIG. 20 so that when actuated by actuator plate 182, at the same time switch 174 is opened, the cycling of the apparatus is discontinued at the position of FIG. 1, in which the hangers 14 are held elevated for removal from the apparatus 10 by the upper end 152 of guide bar 150. Switch 180 is suitably connected to energize a "ready" light 181 that is visible at the housing window 184, indicating that the apparatus is ready for another cycle.

Mounted below the indexing disc 106, and underneath the cam 140, is switch plate 186 to which are suitably applied in the form shown magnetic proximity switches 188, 190, 192, 194, 196, 198 and 200 which are actuated by magnets 202 and 204 suitably secured to and carried by the index disc 106 (which is formed, for this purpose, from a suitable non-magnetic material that is permeable to magnetism, such as brass). Switches 188, 190, 192, 194, 196, and 198 are connected as indicated in FIG. 20 to energize the separate lights that illuminate the respective windows 206, 208, 210, 212 and 214 (see FIGS. 1 and 20) when the respective switches 188, 190, 192, 194, 196 and 198 are actuated by the respective magnets 202 and 204 being disposed in vertical proximity to same. This occurs, of course, when the indexing disc 106 is at its lowered positions with the magnets 202 and 204 disposed in vertical alignment with the respective switches 188, 190, 192, 194, 196 and 198, and indicates that hanger 14 is being treated at the particular station represented by the respective switches of switch plate 186 and lighted window that is involved. In the arrangement shown, switch 188 is for the developer station, switch 190 is for the first rinse station, the switches 192 and 194 for the two fix stations, and switch 200 is for showing that a hanger is at the spin dry station. Switch 198 is connected as indicated in FIG. 20 to energize the spin dry motor 84 when switches 170 are closed by swing arm 110.

The housing of apparatus 10 in the form shown is also equipped with a timer interval setting dial 216 forming a part of timer 175, a power off-on switch 218 and a start cycle switch 220, all electrically connected as indicated in FIG. 20 to perform the functions indicated and to be indicated.

The apparatus is set up for operation by charging the containers or receptacles 34, 36, 38, 40, and 42 with suitable liquids to effect the functions that have been indicated for the respective stations 18, 20, 22, 24 and 26, and applying the hood 61. The apparatus is also suitably connected to a convenient source of electrical power. When it is desired to use the apparatus, the procedure may be as follows for the specific apparatus that is illustrated:

The power off-on switch 218 is operated to turn on the electrical power to the apparatus 10 and the dial 216 set to define the time interval for the "dwell" that the hangers 14 are to have at each station considering such factors as the type of film being developed, the chemicals employed at the developer and fix stations, and the ambient temperature conditions involved.

The apparatus 10 is arranged so that it automatically stops and starts at the position of FIG. 1, at which the support arm 52 is disposed so that its hanger receiving openings 68 and 70 are vertically aligned with the loading and unloading stations 16 and 30, respectively. In this position, the indexing disc 106 rests on top of guide bar 150, slot 130A having previously been indexed to the location that achieves this end. The support arm 52 is therefor elevated to receive a pair of hangers 14, each bearing exposed film 12 to be processed (applied thereto as shown in FIGS. 1, 3, 9 and 10), which are to be applied to the arm 52. The swing arm 110 is downwardly disposed, at this condition of the apparatus, the drive mechanism 108 having previously been shut off by switch arm 110 actuating switch 170, after the indexing disc 106 was rested on top of guide bar 150. At this stage all drive mechanisms of the apparatus are dormant. The hangers are applied to the support arm 52 by having their handle journal portions 66 disposed within the respective mounting openings 68 and 70 of the support arm 52, which is done by passing the hanger rods 60 through the respective slots 72 and 74 and lowering the respective hangers to rest their flanges 63 on the support arm 52. Where the dark room type hood is employed as hood 61, this is done under dark room light conditions with the hood door open, after which such door is closed; where the hood employed is of the daylight type this is done within the hood with the operator working through the hood port holes, as is conventional.

Figure 6:
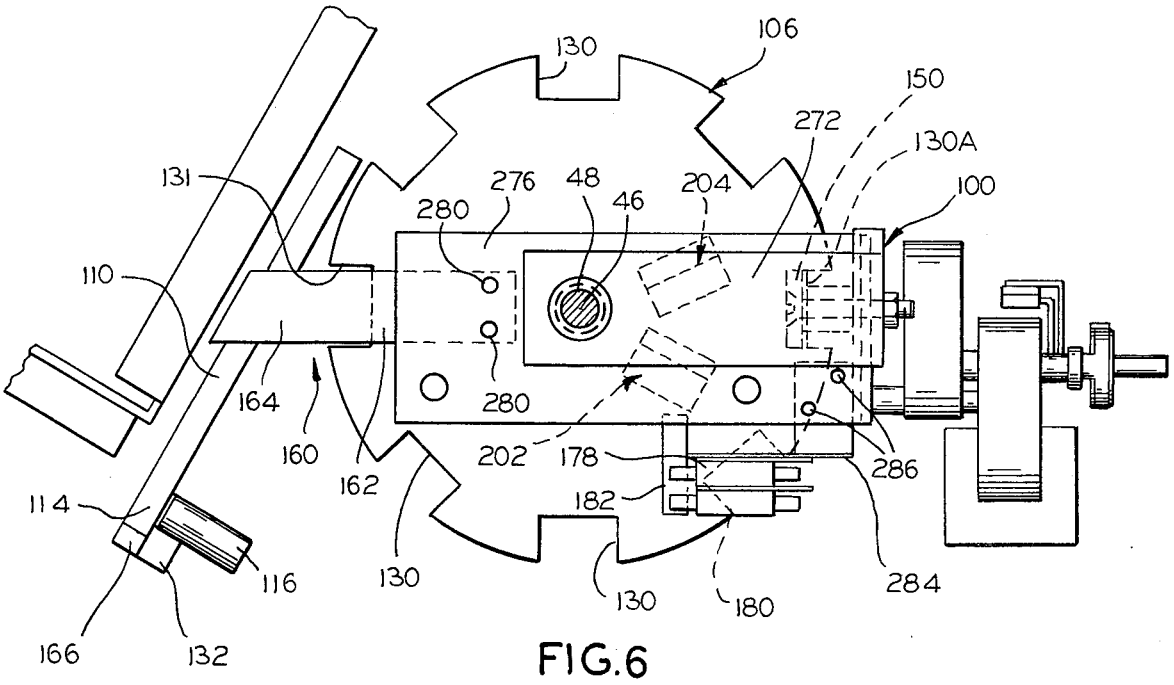
FIG. 6 is a fragmental top plan view of the structure shown in FIGS. 4 and 5.
Figure 5:
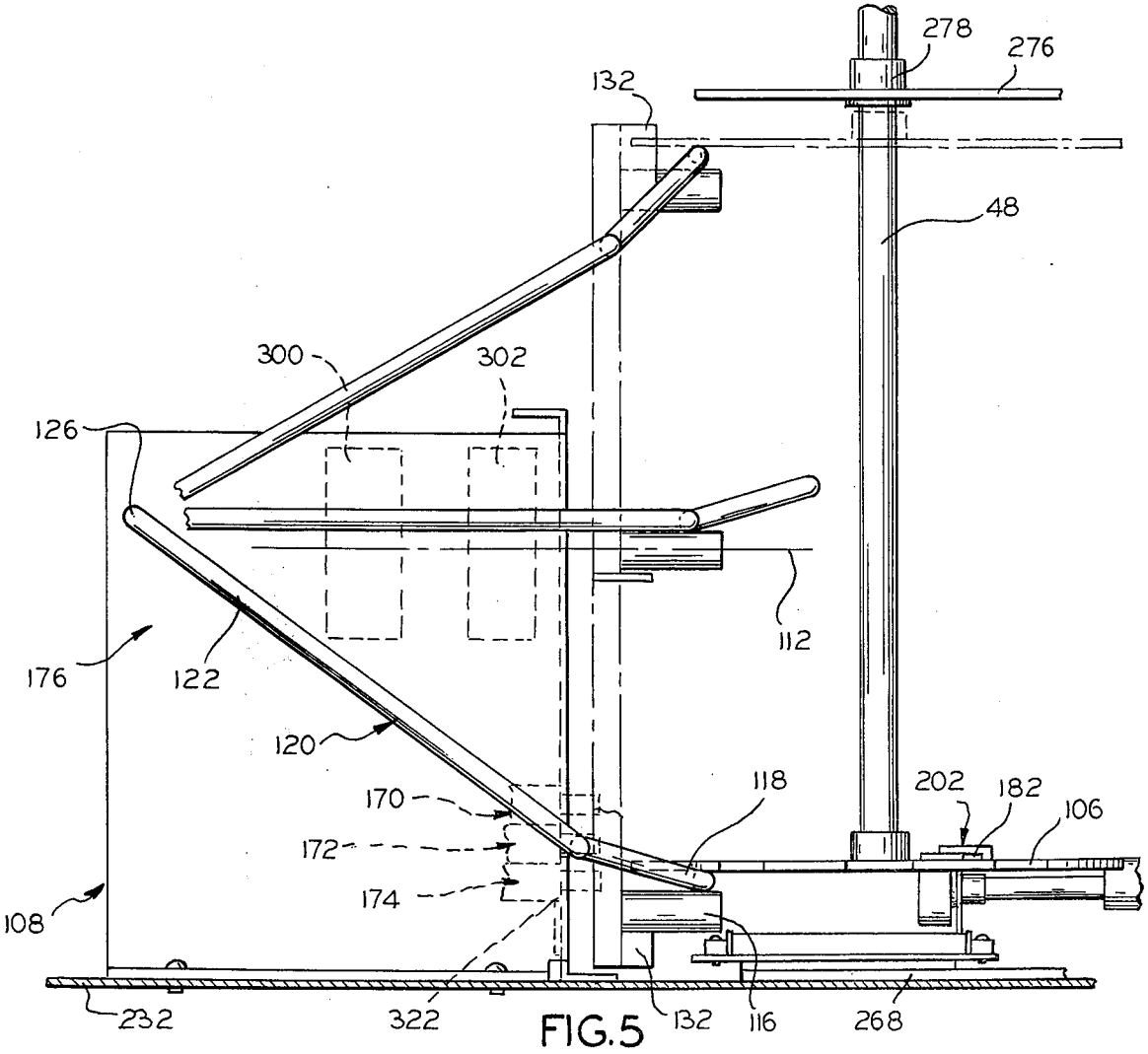
FIG. 5 is a view similar to that of FIG. 4 with regard to the indexing disc, but showing the arrangement for raising and lowering same to accommodate shifting movement of the hangers between stations.
Figure 7:
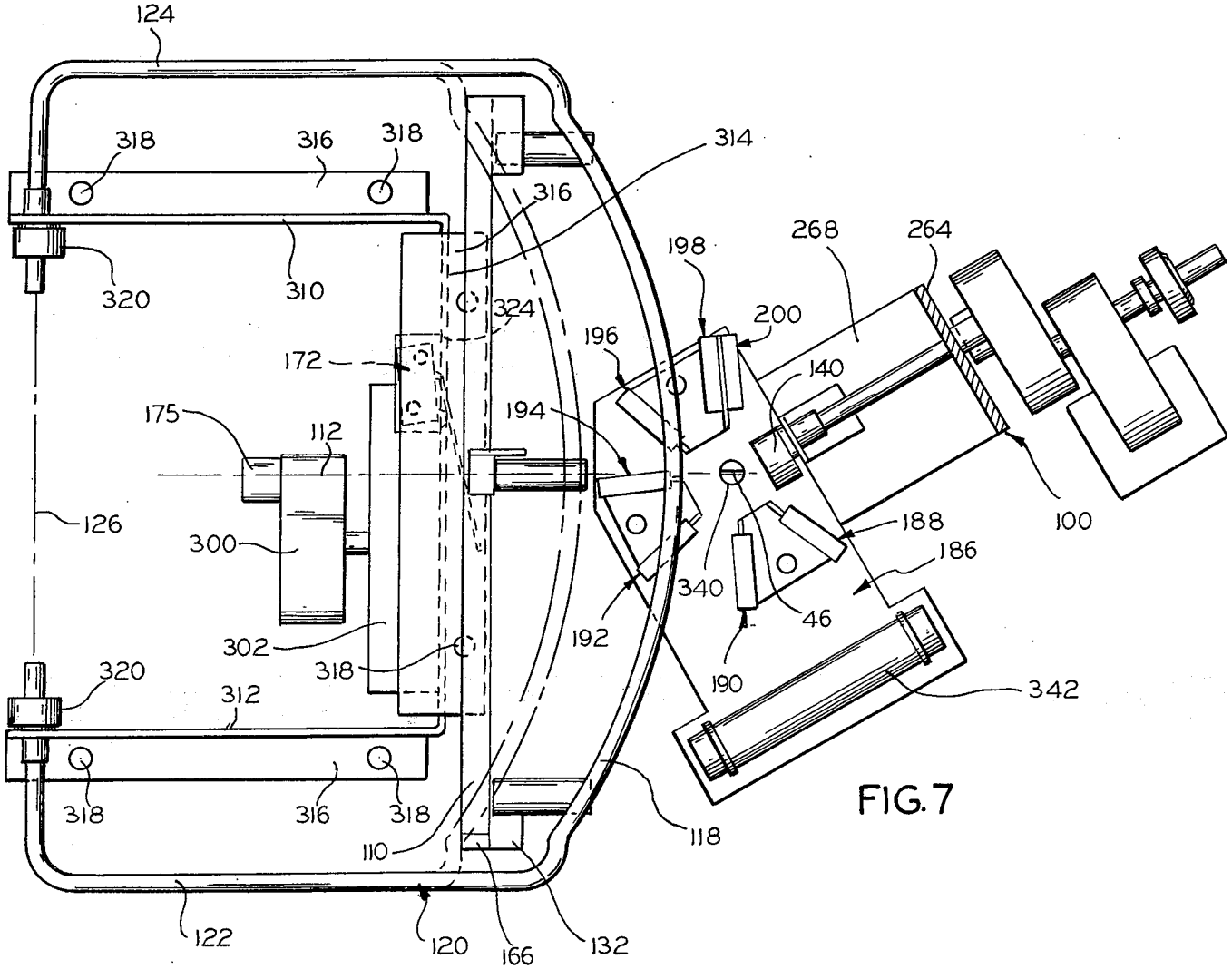
FIG. 7 is a view similar to that of FIG. 6, but omitting the indexing disc and structure above same, and showing more completely the mechanism for vertically moving the indexing disc, the vertical agitation cam and its drive mechanism, and a switch plate and associated switches that are disposed below the indexing disc.

Assuming the hangers 14 have been applied to arm 52, actuation of the processing cycle is begun, in the form shown by actuating the start cycle switch 220, which is electrically connected, as indicated in FIG. 20, to bypass switch 172 to actuate the drive mechanism 108; this effects swinging of swing arm 110 from the downwardly directed position of FIGS. 3 and 5 in a clockwise manner (relative to FIG. 3) to bring the bail member 120, and specifically its bight portion 118, up against the underside of the indexing disc 106 (the cam roller 116 of swing arm 110 moving along the bight portion 118 in a back and forth manner as indicated in FIG. 7 and swinging the bail member 120 in the manner indicated). As the bail member under the action of swing arm 110 lifts the indexing disc 106 free of the upper end 152 of guide bar 150, the beveled corner 166 of the swing arm lifts latch spring 164 upwardly to free same from the notch 130 of the indexing disc 106 (in which it has been disposed) for a sufficient length of time for the swing arm tab 132 to engage a side 131 of the slot 130 that has just been occupied by the latch spring 162, to rotate the indexing disc 106 a sufficient distance clockwise of FIG. 6 to bring the next slot 130 into alignment with the latch spring 162; as the latch spring 162 will now be free of the swing arm 110, the latch spring 162 will snap into the freshly positioned indexing notch 130, at the time swing arm tab 132 slips by the indicated slot side wall 131, to again latch the indexing disc in indexed position, which leaves a slot 130 vertically aligned with guide bar 150, and the slot 130A advanced one position beyond vertical alignment with guide bar 150.

Further swinging movement of arm 110 moves same downwardly to reduce the elevation of the bail member 120, which thus lowers the indexing disc 106; since the guide bar 150 is aligned with a notch 130 of the disc 106, the disc 106 will follow the bail member in its downward movement as the swing arm moves to its downwardly directed vertically disposed position.

At this stage, the first hanger 14 (the one to the left of FIG. 1) will now be positioned as indicated in FIG. 2 and such hanger 14 will be in the process of being lowered into the developer chamber or receptacle 18.

As the swing arm 110 completes its downward movement, it operates switch 170 (which is closed to start agitator drive 148), switch 172 (which is opened to shut off drive 108) and switch 174 (which is opened but of no effect since switch 178 remains closed); swing arm 110 also lowers the bail member 120 to the point where the indexing disc 106 will rest on cam member 140. The indexing disc 106 will now reciprocate or oscillate vertically under the rotating action of cam member 140, and guiding action of guide bar 150, switch 170 having turned on the agitating drive 142. Switch 172 is operated to shut off drive 108 so that swing arm 110 stops at a substantially vertical downwardly directed position; switch 170 also energizes the time delay mechanism of delay interval timer 175 which is suitably arranged and wired to reactuate the drive 108 at the end of the period of time set by the time setting dial 216.

At this stage, the switch 188 will be closed by magnet 202 (which now will be immediately above switch 188) so that window 206 lights up, indicating that the first hanger 14 is being processed at the developer station.

When the delay interval timer 175 times out, mechanism 108 is again actuated to repeat the operating cycle of the swing arm 110 and its cooperating bail member 120, whereby swing arm 110 swings clockwise of FIG. 3 to lift the bight portion 118 of the bail member 120 up against the underside of indexing disc 106 to start lifting the indexing disc 106 and the parts it supports to the upper position of FIGS. 4 and 5. As the swing arm 110 leaves switches 170, 172 and 174, switch 170 is operated (opened) to turn off the agitator drive 142 and the timer motor of timer 175 (which then automatically resets itself and remains dormant until switch 170 is again closed), switch 172 closes to permit continued operation of swing arm drive 108 and switch 174 closes without effect. As swing arm 110 rises to its upwardly extending vertical position, the indexing disc 106 and the parts it supports are moved vertically to lift the first hanger 14 being processed out of the developer receptacle, swing the indexing disc 106 and thus the support arm 52 one station further in the cycle (about axis 46), so that the first hanger 14 is positioned above station 20 while the second hanger 14 is positioned above the station 18. The swing arm 110 then lowers to lower the indexing disc and the parts it supports in the manner aforedescribed, with the result that the indexing disc 106 is again rested on the cam member 140 for vertical agitation as before described, and drive mechanism 108 is shut off, and delay interval timer is actuated to go through its time delay cycle when swing arm 110 reaches the position of FIG. 3.

The apparatus 10 then goes through its dwell period to accomplish a rinsing of the first hanger 14 at the station 20 and the developing action on the films of the hanger 14 at the station 18. After the prescribed dwell period, the machine then functions to move the hangers 14 one station further for the next processing of same. The machine operates in like manner to move the hangers through the fix and rinse stations 22, 24, and 26. The sequencing of the apparatus 10 continues to then apply the first hanger 14 to the spin dry station 28 in like manner, with that hanger's drive coupling element 78 being lowered onto the drive component 80 (and specifically into resting engagement with the O-ring clutch element 81). The magnet 202 then is disposed to operate switches 198 and 200 to illuminate the spin dry window 214 and actuate the spin dry drive motor 84, switch 170 then being closed. As the upper end of the hanger rod is journaled in the support arm 52 at its journaling portion 66, rotation of the drive member 80 will now rotate the hanger and the films 12 carried thereby for spin drying of same within the spin dry container or receptacle 44. In this connection, it is pointed out that the drive member 80 stands sufficiently high relative to cam member 140 so that when the hanger is rested on the drive element 80 there will be sufficient space between the hanger handle flange 63 and the upper side of the support arm 52 to permit the vertical agitation of the indexing disc 106 and the parts it is now supporting even though the initial hanger 14 is now being rapidly rotated for drying purposes. AS indicated, the rotational speed involved is preferably on the order of 3,000 rpm.

At the end of the apparatus dwell period, the apparatus 12 functions in like manner to dispose the initial hanger 14 at the unloading station 30 and dispose the second hanger 14 within the spin dry receptacle 28 for spin dry operation of same in like manner. At the end of the second spin dry operation, the drive mechanism 108 functions for the final time to raise and rotate the support arm 52, by the lifting action of the bail member on the indexing disc 106, and the engagement of the swing arm tab 132 with the indexing disc notch 130 positioned for that purpose to swing the indexing disc 106 and support arm 52 to the position of FIG. 1, which now vertically aligns the notch 130A of the indexing disc 106 with the guide bar 150, whereby as the bail member 120 lowers the indexing disc 106 is rested on top of the guide bar 150 to dispose the two completed hangers 14 for inspection and removal. The swing arm 110 returns to the downwardly directed position, and switch 180 is actuated (closed) by actuator plate 182 to illuminate window 184; switch 178 is opened by actuator plate 182. Drive 108 continues to function to dispose the swing arm 110 to actuate switches 170, 172 and 174 as aforedescribed; as switch 178 remains open by the at rest position of actuator plate 182, and switch 174 is now open, the cycling of apparatus 10 stops until restarted by manually closing switch 220.

Further hangers 14 may then be processed in like manner.

SPECIFIC DESCRIPTION

The housing 32 of the apparatus 10 in practice may be of any suitable type, that shown including upper and lower floors 230 and 232 (see FIG. 4) secured to a suitable framework (not shown) to which are also applied front shell member 236 (having the various openings formed in same to accommodate the lighting windows and switches that have been referred to), side shell members 238 and 240, and rear shell member 242, which may be secured to the frame by employing screws or the like.

The housing 32 rests on a suitable hollow base 244 which may have one side of same openable to house miscellaneous equipment, associated with apparatus 10.

The hood 61 may be of any suitable type that is proportioned to close off the stations involved and accommodate the movements of the support arm 52 and the film hangers 14 it carries as the device operates. As is well known in the art, where the hood is of the dark room type, the loading of the hangers must be done under appropriate safelight conditions, while if the hood is of the daylight type, the film may be loaded on the hangers under daylight conditions, with the operator working through protected port holes in handling the film and hangers. Such hoods removably rest on the housing shoulder 59, and are equipped with a suitable access door (not shown) on loading and unloading station, or front side, of the apparatus 10.

The various receptacles or containers 34, 36, 38, 40, 42, and 44 rest on the upper housing sheet 230 and have received about them the decorative top shell 248 which likewise may be secured to the frame employing suitable screws or the like. The containers or receptacles 36 and 42 are preferably connected to suitable water purifying means, for minimizing the developer and fix content they contain, respectively, which may be self-contained units housed in base 244. Overflow pipes 250 and 252 are provided in the receptacles 36 and 42, respectively, to catch overflow of the liquids in these containers as fresh liquid is supplied. Water temperature of 70° F. is preferred.

The spin dry container or receptacle 44 has its lower end upwardly indented at its midportion 253 to define an annular trough portion 255 in which liquid flung from the hangers during the spin dry operation collects for discharge from suitable outlet 257 (see FIG. 1). Spin dry motor 84 is suitably secured to housing sheet 230 below container 44.

The spin dry coupling elements 78 and 80 define complementing frustoconical surfaces 259 and 261 (see FIG. 11), with the friction clutch O-ring 81 (which may be a conventional O-ring seal element of convenient size, and thus is formed from a suitable rubber or plastic base material) being received in groove 263 formed in coupling element surface 261.

The top shell 248 is indented as at 254 in the area of the loading and unloading stations 16 and 30 to serve as a work area. Stations 16 and 30 actually serve dual functions of loading and unloading as prior to processing the two hangers 14 are applied to the support arm 52 at the stations 16 and 30, and after processing the hangers 14 may be disposed at the same stations for unloading, if the first hanger is left on the support arm 52 until spin drying of the second hanger 14 is completed. It will be apparent that only one hanger 14 need be processed at a time, if so desired, in which case the hanger would be applied to arm 52 at station 16. Similarly, arm 52 may be arranged to accommodate only a single hanger 14, if so desired.

The support structure 100 comprises an upper bar member 260 (see FIG. 4) having the lower end 262 of same secured to a lower bar member 264, as by employing suitable nut and bolt type fastening devices 266. The lower member 264 has its end 268 angled to rest on the lower floor sheet 232 and be appropriately secured thereto, by employing suitable screws, one of which is indicated at 270. The upper end 262 of the upper bar member is angled horizontally and mounts suitable bearing sleeve 274 in which support rod 48 is slidably and rotatably mounted.

The upper end 276 of the lower bar member 264 is also angled horizontally to mount a similar bearing sleeve 278 for similar purposes. The latch spring 262 is suitably anchored to the lower bar member upper end 276 as by employing a suitable connecting device, such as rivets 280. The switches 178 and 180 are suitably gang mounted on angle bracket 284 that is affixed to the lower bar member upper end 276, as by employing appropriate rivets where indicated at 286, so as to position the switch arms of the switches 178 and 180 for engagement by the actuator plate 182 that is carried by the indexing disc 106.

A suitable brace rod 290 is applied between the support bar ends 272 and 276, as by employing suitable fastening screws or bolts 292 and 294. Support structure 100 extends through a suitable interruption 295 formed in housing sheet 230.

The guide bar 150 is secured in its upright position by employing suitable nut and screw devices 296 that are applied between same and bars 260 and 264, with spacers 298 being disposed between the guide bar 150 and the bar member 264 that are proportioned to dispose bar 150 relative to the path of movement of the indexing disc 106 such that the bar will be slidably received in the indexing disc grooves or notches 130, but not the notch 130A.

The swing arm drive 108 generally comprises a suitable electrically driven motor 300 and associated gear reducer appropriately mounted in housing 176, which housing in the form shown is of one piece, three-sided construction defining side portions 310 and 312, and front portion 314 that are respectively flanged as at 316 for securement to the lower floor sheet 232 as by employing suitable screws 318. The side portions 310 and 312 have suitably mounted on same suitable bearings 320 in which the end portions 122 and 124 of the bail member 120 are journaled for rotation about said axis 126.

The microswitches 170, 172 and 174 are suitably gang mounted on suitable angle bracket 322 that is suitably affixed to the housing front portion 314 just below the window area 324 (see FIG. 7) formed in the housing front portion 314 so that the switch arms of the respective switches 170, 172 and 174 appropriately project into the path of movement of the swing arm 110.

The drive mechanism 148 of agitating device 142 comprises suitable electric motor 330 and associated gear reducer 332 appropriately mounted within the housing 32, as by being suitably secured to support structure 100 (see FIG. 4), with the shaft 144 passing through the lower bar 264 and being journaled at its end 334 in angle bracket 336 that is suitably secured to the lower bar end 268. Preferably drive mechanism 148 rotates shaft 144 at a speed of 60 rpm, and cam member 140 is fixed to the shaft 144 eccentrically so as to provide the indexing disc 106 and the parts it supports with a vertical reciprocation of three-quarters of an inch in length.

Switch plate 186, on which switches 188, 190, 192, 194, and 196 are suitably mounted, is suitably secured in place by employing appropriate fastening devices, one of which is shown at 340. Plate 186 in the form shown also mounts a terminal strip 342 that is only diagrammatically illustrated, and to which the respective switches mounted on the plate 186 are electrically connected for connection to the parts they control an appropriate source of electrical energy and other circuitry that may be necessary or desirable for proper functioning of the apparatus 10 in accordance with the procedures and manner of operation that have been indicated.

As will be observed in FIGS. 6 and 7, the plane of the support structure 100 is at an angle of 62 degrees relative to the vertical plane which includes the axis of rotation 112 of swing arm 110, the latter vertical plane also including the axis of rotation 46 of support rod 48, with the switches of switch plate 186 being oriented on radii extending from the axis 46. This orientation of parts facilitates the cooperation of the swing arm 110 with indexing disc 106.

Figure 8:
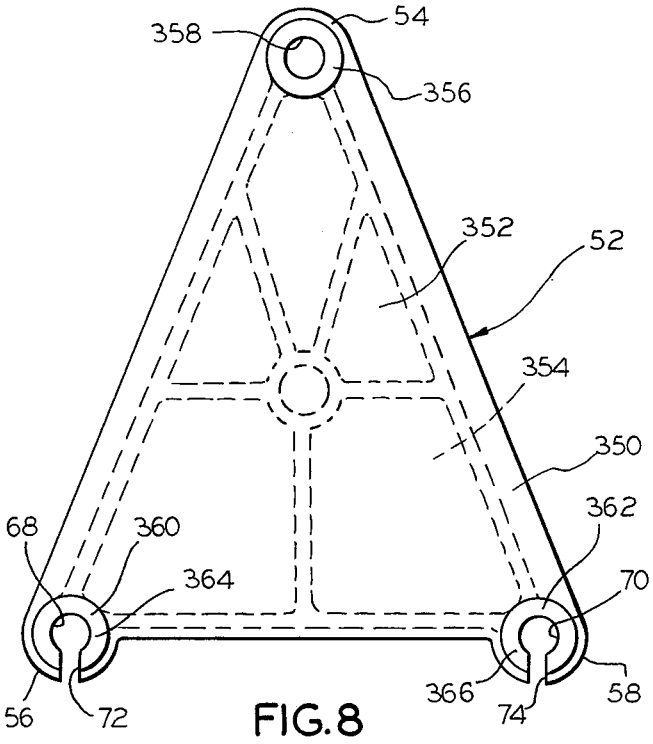
FIG. 8 is a plan view of the hanger support arm of the apparatus of FIGS. 1 – 7.

Referring now more specifically to the showings of FIGS. 8 – 19, the support arm 52 in the form shown comprises a triangular shaped one piece element 350 formed by a suitable molding process from a suitable wear resisting plastic compound, such as glass filled celcon and shaped to define, in addition to the apexis 54, 56 and 58, a planar upper surface 352 and an undersurface 354 that is ribbed as indicated in FIG. 8 for strengthening purposes. Apex 54 is bossed as at 356 about opening 358 of same into which the upper end of support rod 48 is suitably affixed.

The apexes 56 and 58 are similarly bossed as at 360 and 362, respectively, about the respective openings 68 and 70, with the openings 68 and 70 substantially complementing in diameter the external diameter of the journal portions 66 of the hangers 14. The bosses 360 and 362 are formed with planar upper surfaces 364 and 366, respectively against which the hanger flange portion 63 bears when the respective hangers are suspended from the support arm 52.

The spacers 92 each comprise a one piece body 370 (see FIGS. 12 and 13) formed from a suitable plastic material such as Nylon. The body 370 is annular in configuration defining bore 372 having the diameter that substantially exceeds that of the hanger rod 60, a plurality of studs 374 projecting from the otherwise planar ends 376 and 378 of same, and spaced side grooves 380 that are spaced 90 degrees apart about the circumference of the respective spacers 92. The space ends 376 and 378 are also slotted as at 382 transversely of the spacer and in intersecting relation with the respective grooves 380.

The spacers 92 may be formed by a suitable molding procedure or the like.

The film holder devices 90 each comprise a plurality of film clip members 94 that are preferably formed from suitable stainless spring steel, a film clip holder 392, and a pair of clip plates 394. As indicated in FIGS. 9 and 10, the film clip members 94 are received in the film clip holder 392, and the clip plates 394 are disposed on either side of the holder 392.

Figure 19:
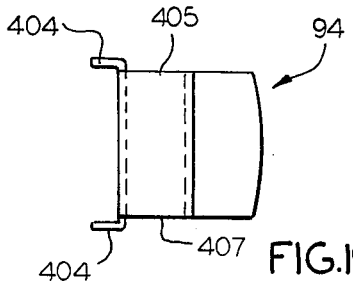
FIG. 19 is an end view of the clip member shown in FIG. 18.

The film clip members 94 are each of identical, generally U-shaped configuration defining spaced legs 396 and 398 connected by bight portions 400, with the leg 398 having an elongate handle forming extension 402 disposed at an angle of approximately 45 degrees with respect to the leg 398. Leg 398 is also formed on either side of same with tangs 404 that are directed laterally of the member leg 398 and oppositely of the leg 396 and thus extend in parallelism and lateral alignment away from the leg 398. As indicated in FIG. 19, the tangs 404 are disposed exteriorly of the plane of the member legs 396 and 398, and each terminates in an angled edge 409 (see FIG. 18).

Figure 14:
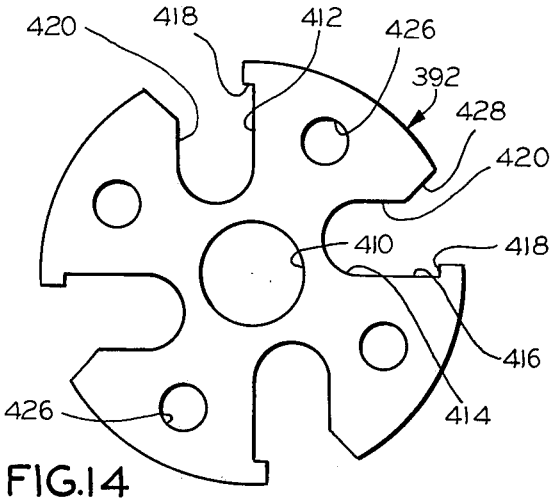
FIG. 14 is an end view of a film clip holder forming a part of the hanger of this invention.
Figure 15:
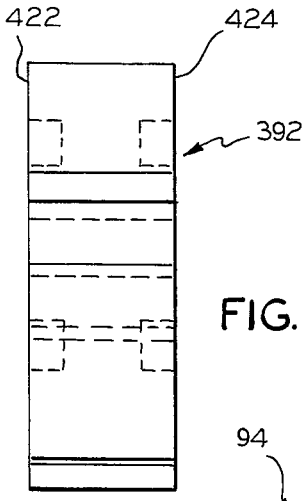
FIG. 15 is an elevational edge view of the holder shown in FIG. 14.
Figure 16:
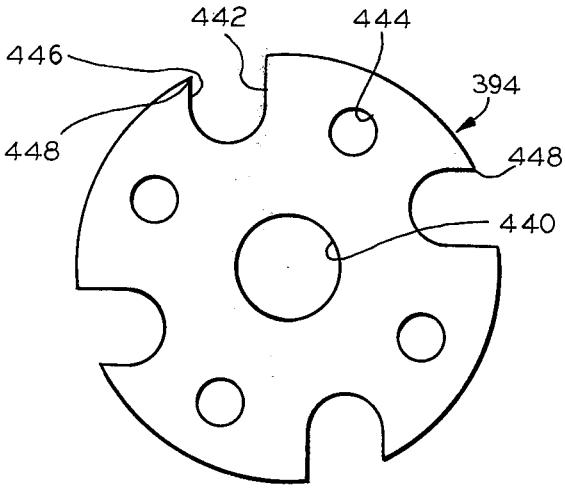
FIG. 16 is a plan view of a clip plate that forms a part of the hanger of this invention.
Figure 17:
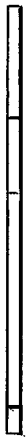
FIG. 17 is an edge view of the plate shown in FIG. 16.
Figure 18:
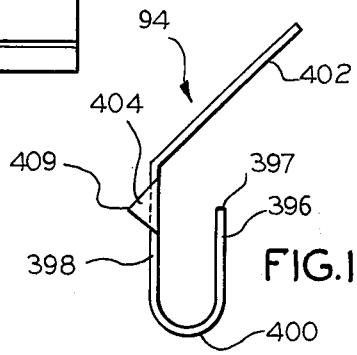
FIG. 18 is an edge view of the film clip member that is employed in connection with the hanger of this invention.

The clip holder 392 is formed from a suitable plastic material, such as Nylon, and is shaped to define central bore 410 that closely receives the angle rod 60, four generally U-shaped slots 412 that are equally spaced about the periphery of the member 392 that are adapted to receive the respective clip members 94 forming a part of the respective devices 90. As indicated in FIG. 14, the slots 412 are each formed to define a U-shaped portion 414 that receives the legs 396, 398 and bight portion 400 of the respective members 390, with the slot side wall 416 (which incidentally lies on a radius of bore 410) being formed to define an internal shoulder 418 under which the terminal end 397 of leg 396 is seated.

The leg 398 of the respective members 390 is seated along the slot side wall 420. The member 94 is dimensioned between its edge surfaces 405 and 407 (see FIG. 19) so that when the respective members 94 are received in the respective slots 412, the edge surfaces 405 and 407 will be in approximate alignment with the planar ends 422 and 424 of the members 392.

The members 392 are also indented or recessed as at 426 to receive the respective studs 374 of the respective spacers 392.

The side 420 of the respective notches 412 is beveled as at 428 to provide adequate working space for the legs 398 of the members 94.

The clip plates 394 are formed from stainless steel and are shaped to define central bore 440 that closely receives the hanger rod 60, U-shaped slots 442 that are equally spaced about the periphery of the plate 394 and that are disposed to one side of radial alignment with the axis of the bore 440, and spaced perforations 444 that receive the respective studs 374 of the spacer members 92.

The clip plates 394 are disposed on either side of the holder members 392 in the manner indicated in FIG. 10 from which it will be observed that the shorter side wall 446 of the respective slots 442 defines an angled edge portion 448 that is in the nature of a tang disposed to oppose the clip member tangs 404 of the respective members 390 when the clip devices 94 are in assembled relation.

It will thus be seen that the tangs 404 of the respective clip members 94 for each clip device 94 are disposed in the planes of the respective clip plates 394 thereof so that on either side of the device 90, at each clip member 94, a tang 404 is disposed in direct opposition to a clip plate edge 448.

The devices 90 and the spacers 92 are assembled in stacked relation on the respective hangers 14, and as shown in FIG. 9, a first spacer 92 is applied over rod 60 against the hanger coupling member 78, to be followed by a clip plate 394, a holder member 392, containing four of the clip members 94, with the first clip plate 394 having its apertures 444 receiving the upstanding studs 374 of the first spacer 92 (the corresponding studs 374 on the other end of which have been removed, in the specific holder shown in FIG. 9) for flush engagement of the space body with the coupling member 78. Similarly, the said studs 374 of the initial spacer 92 are received in the recesses 426 of the indicated holder member 392.

The second clip plate 394 is then applied to the indicated holder member 392 and positioned to align its apertures 444 with the recesses 426 on the side of the holder member 392 facing same. The next spacer 92 is then applied on top of the first clip holder device 90, with the studs 374 on the side of same that engages the second clip plate 394 being inserted through the apertures 444 of the clip plate 394 in question and into the recesses 426 of the clip holder 392 in question.

Of course, the clip members 390, the holder members 392, and the clip plate members 394 are oriented with respect to each other in a manner indicated in FIG. 10 so that the tangs 404 of a particular clip holder 390 are disposed oppositely of the edge portions 448 of the respective clip plates 394.

It is also to be noted that the angulation of the clip member handle forming extensions 402 is such that the extensions 402 of adjacent clip members 94 of a clip device 90 are disposed normally of each other (see FIG. 10). This permits one of the clip members to be operated to separate its tangs 404 from the edge portions 448 opposing same so as to receive a film 12. Thus, for instance, if the operator should place his left hand thumb on the clip member extension marked X and his left hand forefinger on the end Y of the clip member extension Z in FIG. 10, the clip member having the extension X may be opened as indicated by the two position showing of FIG. 10 to receive a film 12. The respective clip members 94 have a resilient spring action so that on release they return to the broken line position at the lower portion of FIG. 10, with the clip members 390 being shaped so that the tang edges 409 of their respective tangs 404 engage against the respective edge surfaces 448 opposing same with a spring biased gripping action.

The angled edge portions represented by the tang edges 409 and the clip plate edge portions 448 form a two-point gripping action on the respective films, resulting in slight indentations being formed in the film material to securely hold the film material in place. It has been found that this arrangement securely holds the individual films against the spin dry operation contemplated by this invention; both acetate and polyester based film materials are handled effectively by the clip devices 90. The indentations formed in the film are so small that they do not adversely effect the quality of the film.

It will also be noted that when the clip devices 90 are each provided with the four films 12 that they are intended to hold, the films 12 project at 90 degree intervals about the hanger, and they lie substantially along radii of the hanger when the hanger is at rest.

The grooves 380 of the spacers are oriented relative to the clip members 94, the clip holders 392, and the clip plates 394 of the respective clip devices 90 such that they serve as a guiding aid in inserting the end of a film 12 between the tangs 404 of a particular clip member 390 and the clip plate edge portions 448 opposing same. As indicated in FIGS. 9 and 10, the grooves 380 of the spacers 92 are aligned longitudinally of the hanger and are disposed on either side of each clip device 94, and since the individual films 12 will ordinarily be wider than the depth of the respective devices 94, the spacers provide an insertion guiding action, by virtue of their grooves 380, on either side of each device 94.

The spacers 92 being well spaced radially from the rod 60, and being recessed at their ends as at 382, provide for rapid drainage of liquids from the hanger on removal of the hanger from a bath. Thus, the slots or notches 382 form with the clip plates 394 adjacent same drain openings 480 (see FIG. 9) from which bath liquid readily discharges.

In the particular hanger shown in FIG. 9, the top spacer 90 has a single clip plate 394 applied to same with the upper end of same having the studs 374 removed. Suitable lock ring 482 applied to a groove (not shown) formed in the hanger rod 60 holds the spacers and clip devices 90 in assembled relation.

The hangers 14 can be spun in either direction for spin drying of the film. Preferably, however, the direction employed is counterclockwise of FIG. 10 so that there is no chance of a film 12 striking an upstanding end Y of a clip member 94.

With reference to the electrical control circuit that is schematically shown in FIG. 20, power lines 490 and 492 are suitably connectable to a suitable source of electrical alternating current power through off-on switch 218. Power line 492 is connected to terminal 494 of timer unit 175 which has jumper connector 496 extending between terminal 494 and common terminal 498 from which line 500 extends to terminal 502 of switch 172. Connector 504 extends between terminal 506 of timer 175 and terminal 508 (of switch 172) which is connected to motor 300 of the swing arm drive 108 and back to line 490 in the manner indicated in FIG. 20.

The timer device 175 is equipped with a solenoid operated mechanism indicated at 510, and electrically connected between the terminals 494 and 512, that is energized, when switches 170 and 178 are both closed, by connector 514 extending between terminal 512 and terminal 516 of switch 170. The timer 175 is arranged so that when the solenoid operated mechanism 510 is energized on closure of the switch 170, the timer terminals 498 and 513 are closed to drive the timer motor 518 through line 514 and switches 170 and 178 until the timer times out, at which time timer terminals 498 and 506 are closed to actuate the swing arm motor 300 for restarting movement of the swing arm 110 at the end of a period of dwell (with the indexing disc 106 and hangers 14 in their lowered positions). Of the switches actuated by swing arm 110, switch 170 is normally open while switches 172 and 174 are normally closed, which positions are reversed when these switches are engaged by swing arm 110 when in its downwardly extending position; thus, when swing arm motor 300 is restarted (when the timer 175 times out), switch 172 closes to continue operation of motor 300 through line 500, and timer motor 518 is disconnected electrically at switch 170, timer 175 automatically resetting itself and remaining dormant until switch 170 is again closed (while switch 178 remains closed).

Transformer 520 supplies electric power to isolated low power light circuit 522 in which the switches 180, 188, 190, 192, 194, 196 and 200 are incorporated to illuminate the respective window lights 181, 526, 528, 530, 532 and 534 for the respective windows 184, 206, 208, 210, 212 and 214, as well as lights 536 and 538 that eliminate the off-on switch 218 and the start cycle switch 220, respectively. Of course, the illumination of the various lights controlled by the switches arranged for opening and closing by the positioning of the indexing disc 106 is turned off and on depending on the relative positioning of the indexing disc 106.

The spin dry motor 84 and agitation drive motor 330 are connected in parallel across connectors 514 and 500, as well as, in the showing of FIG. 20, an electrically controlled valve 540 and pump motor 542 of built in water supply equipment in a form of the device where the water supplies of the self-contained type including a pump and valve controls for recirculating this water through a suitable filtering system (not shown as these are operational features).

It will thus be seen that in the circuit of FIG. 20, the closing of start cycle switch 220 initially actuates the motor 300 of swing arm drive 108 which thus moves the swing arm away from its downwardly directed position of FIG. 3 and out of contact with the switches 170, 172 and 174 to effect opening of normally open switch 170 and closing of normally closed switches 172 and 174. The start of the cycle also opens normally opened switch 180 and closes normally closed switch 178.

The apparatus is then conditioned so that when the swing arm 110 next reaches its downwardly directed position to engage the switches 170, 172 and 174, switch 170 will be closed to energize the agitation drive motor 330 and the water circulation control valve and pump mechanisms (but not the spin dry motor 84 until switch 198 is closed by the sequential positioning of indexing plate 106).

When the cycling of the machine brings the hangers to the spin dry station, the proximity switch 198 is closed to permit operation of the spin drive motor 84 through switches 170 and 178 which are then closed.

After the second hanger has been processed at the spin dry station, and the indexing disc 106 is rested on top of guide bar 150, switch 178 is opened by the then position of disc 106 so that when switch 174 is next opened by the return of the swing arm 110 to its downwardly directed position, the cycling of the apparatus stops.

The electrical arrangement is made such that if a particular radiographic technique employed requires a "fast" diagnosis prior to completion of processing of the film, the film may be removed after the first fix for a "wet" look. This can be done by shutting off the power switch 218 a few seconds after the light 530 for the fix station goes out, which shuts down the system. The film may then be removed and inspected, and returned to the machine, after which the power is then turned on and switch 218 and the apparatus will automatically complete its cycling to complete processing of the valve in question.

In the circuit of FIG. 20, a safelight receptacle 540 is provided for across the line to which a safelight (not shown) that is conventionally provided in hood 61 may be connected.

It will therefore be seen that this invention provides a fully automatic film processing device of the dip and dunk type which provides for complete development processing of the film to the extent that the film is dry for all practical purposes when processing is completed thus permitting immediate inspection and mounting of the individual films as desired.

The station arrangement includes a rinse in between the developer and fix baths which has been found to improve keeping qualities of the film in the sense that tendencies of the film to turn brown, due to developer remaining on it, are eliminated.

The gentle vertical agitation that is provided at each station greatly facilitates the action of the liquids at each station.

The spin dry operation in the machine is simply performed, requiring only the simple journaling type mounting of the individual hangers at their upper ends where they are supported by the apparatus support arm, and gravity connection with a friction clutch in the spin dry chamber or receptacle which transmits the rotational forces to the individual hangers to achieve the desired spin drying speed of 3000 rpm.

The individual hangers include a plurality of film clip devices that securely clip the individual films in the place in spaced relation about the periphery of the hangers and longitudinally thereof. The film clip devices come in sets so that any desired number of sets can be applied to a hanger depending on the length of the hanger and the depth of the film processing receptacles.

The arrangement of the film clip holders of each film holder device facilitates the opening of each film holder as well as the spacing of the individual films from each other about the periphery of the hanger.

While the invention is particularly applicable to the development of dental X-ray film, it is apparent that films for other purposes may be similarly processed following the teachings of the invention.

The apparatus as illustrated is arranged to process all types and sizes of intra-oral dental film, namely bite wing, periapical, and occlusal films. The hangers illustrated will accept up to 20 bite wing or periapical films, or up to 8 occlusal films (which should have their longitudinal edges applied to the hangers because of the size of the film of this type).

The invention is arranged to take human error and ineptitude out of film processing as well as eliminating problems caused by the need for rollers, gears, belts, heaters, relays and thermostats in prior art developers, especially those of the conveyor type. After being applied to the hangers, the film touches only processing liquids during operation of the machine. Drying is effected without the need for supplying heat to the film. The apparatus requires little maintenance other than proper servicing of the liquid baths involved.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A film hanger for use in developing dental X-ray film and the like, said hanger comprising:

a handle member defining a rectilinear rod portion, a U-shaped clip spring member defining spaced legs and a bight portion and having on one leg thereof a pair of spaced gripping tangs projecting from either side of same oppositely of the other leg thereof in substantial parallelism with the plane of said clip spring member, said one leg of said clip spring member including a projecting handle portion extending away from said bight portion thereof, a clip spring holder member mounted on the handle member rod portion and comprising an annular body received over said rod portion, said body being formed with a U-shaped slot in the plane thereof in which said clip spring is received in close fitting relation thereto with said handle portion thereof projecting outwardly of said slot and said tangs disposed on either side of said slot exteriorly of said body, and a pair of disc elements disposed one on either side of said body in close fitting relation thereto, said disc elements each being formed to define a notch for receiving the respective clip spring tangs and a protuberant edge portion opposing the respective tangs whereby a film may be gripped by said tangs pressing same against the respective edge portions.

2. The film hanger set forth in claim 1 wherein:

said body and said disc elements are formed to receive four of said clip spring members in ninety degree spacing about said rod portion, with said disc elements being formed with said notches and edge portions for said gripping of film by the pressing of said tangs against said edge portions opposing same, said clip spring member handle portions being oriented for finger operation of one of said clip spring members to separate the tangs thereof from said edge portions opposing same to release or receive a film by using an adjacent clip member handle portion as a purchase to effect finger pressure on said one clip spring handle portion to separate the tongs thereof from said edge portions opposing same.

3. The film hanger set forth in claim 2 wherein:

said body, said disc elements and said clip spring members form a multiple film holding assembly, said rod portion having a plurality of said assemblies mounted thereon in spaced relation, and an annular spacer member interposed between adjacent of said assemblies, said spacers being grooved adjacent the tangs of the respective assemblies to locate the film for gripping by the respective tangs and edge portions.

4. The film hanger set forth in claim 3 wherein:

said spacers are bored axially thereof and are slotted laterally thereof for ready draining of liquids therefrom.

5. The film hanger set forth in claim 3 wherein:

said handle member includes means at either end of same for mounting said handle member for spin drying of film held by said hanger.

6. In film developing apparatus having a frame defining processing stations including loading and unloading stations and a plurality of receptacles disposed in an arcuate path concentric about a vertical axis, a carrier member mounted for rotation about said axis in a substantially horizontal plane over said receptacles, means for dependently supporting from said carrier member one or more film hangers positioned for sequential insertion into said receptacles, means for intermittently rotating said carrier member to move said hangers about said path, means for raising and lowering said carrier member in strokes of predetermined length in timed sequence to said rotating means to dispose said hangers elevationally to be moved from one of said receptacles to another in sequence and lower said hangers for insertion into the respective receptacles, and means for moving said carrier member while in the lowered position thereof for agitating the hangers when disposed within the respective receptacles, the improvement wherein:

said stations include in sequence about said axis said loading station, a developer station, a rinse station, a fix station, a final rinse station, a drying station, and said unloading station, said developer, rinse, fix and drying stations being defined by said receptacles, said hangers including means for clipping to the hangers the individual films carried thereby, and including means for spinning the individual hangers when disposed at said drying station and within the receptacle thereof for spin drying of the film carried by the individual film hangers, said spinning means including;

means for rotatably removably mounting the individual film hangers on said carrier member, a spin driving member journalled in the lower end of said drying station receptacle, means for selectively spin driving said spin driving member, and means for releasably coupling the individual hangers to said spin driving member when the individual hangers are disposed within said drying station receptacle.

7. The improvement set forth in claim 6 wherein:

said carrier agitation moving means comprises means for reciprocating said carrier vertically a limited amount, said clipping means including means for effecting a two-point gripping action on the individual films.

8. The improvement set forth in claim 6 wherein:

said stations include a second fix station between the first fix station and the final rinse station, with said developer, rinse, fix and drying stations being within said frame, said loading and unloading stations being in adjacency exteriorly of said frame.

9. The improvement set forth in claim 6 wherein:

said spin driving member drives the individual hangers coupled thereto at a speed on the order of 3000 rpm.

10. The improvement set forth in claim 6 wherein said means for coupling the individual hangers to said spin driving member comprise:

said spin driving member being in the form of an upright conical element having an annular friction coupling member mounted on same in encircling relation and upstanding from said conical element, with the individual hangers at their lower ends having a cup element fixed thereto for resting on said coupling member when the individual hangers are in their lowered positions within said drying station receptacle.

11. The improvement set forth in claim 6 wherein:

said carrier member is mounted on a support aligned with said axis and having an indexing disc fixed thereto, said raising and lowering means comprising:

a bail member of generally U-shaped configuration defining bight portion and opposite end portions extending from said bight portion, means for pivotally mounting said bail member end portions for pivotal movement about a horizontal axis located at a level adjacent the midportion of said raising and lowering means strokes, said bail member bight portion underlying said indexing disc in the lowered position of said carrier member for lifting engagement with said disc when said bail member is raised from the lowered position thereof, and means for raising and lowering said bail member bight portion to raise and lower said disc, said support, and said carrier member.

12. The improvement set forth in claim 11 wherein said carrier member agitation moving means comprises:

an eccentric cam member mounted for rotation about a horizontal axis below said indexing disc, and means for rotating said cam member, said bail member resting said indexing disc on said cam member in the lowered position of said support member.

13. The improvement set forth in claim 11 wherein:

said means for raising and lowering said bail member comprises:

swing arm mounted for rotation about a horizontal axis adjacent said level of said bail member pivotal axis and extending substantially normally of same, said swing arm being disposed within said bail member and having a projecting end portion engaging said bail member between said end portions of said bail member for raising and lowering said bail member bight portion on rotation of said swing arm about said axis thereof, and power means for rotating said swing arm about said axis thereof.

14. The improvement set forth in claim 13 wherein:

said means for rotating said carrier member comprises:

said indexing disc being notched at equally spaced points about its periphery corresponding in number to the number of said stations, said swing arm being positioned to have said projecting end of same engage successive notches of said disc for rotating said disc a predetermined amount on each rotation of said swing arm, and at the level of maximum elevation of said disc under the action of said bail member in raising said disc, means for holding said indexing disc against rotation, said holding means comprising:

an upright stationary member mounted adjacent the vertical path of movement of said indexing disc under the action of said bail member, said upright member being received in indexing relation with successive notches of said disc when said disc is below said maximum level, and a latching member positioned to engage the disc notches, that are engaged by said swing arm projecting end for said intermittent rotation of said disc, and at said level of maximum elevation of said disc, said swing arm projecting end including means for deflecting said latching member from latching engagement with said disc when said swing arm projecting end engages the disc notches for intermittently rotating said disc.

* * * * *